US006155495A

United States Patent [19]

Jones

[11] Patent Number: 6,155,495

[45] Date of Patent: Dec. 5, 2000

[54] TRAMPOLINE SPRINKLER SYSTEM

[76] Inventor: Elaine C. Jones, 6521 Zollman Rd., Otisco, Ind. 47163

[21] Appl. No.: 09/238,598

[22] Filed: Jan. 28, 1999

[51] Int. Cl.[7] ..... B05B 15/00

[52] U.S. Cl. ..... 239/289; 482/27

[58] Field of Search ..... 239/266, 267, 239/268, 269, 273, 279, 289, 548, 556, 566, 568; 482/482, 27

[56] References Cited

U.S. PATENT DOCUMENTS

| | | | |
|---|---|---|---|
| 2,770,812 | 11/1956 | Whiteside | 239/289 |
| 4,205,670 | 6/1980 | Owens | 128/134 |
| 4,725,094 | 2/1988 | Greer | 297/229 |
| 4,822,053 | 4/1989 | Flaherty | 273/411 |
| 4,836,530 | 6/1989 | Stanley, Jr. | 272/65 |
| 5,007,766 | 4/1991 | Freed et al. | 405/24 |
| 5,154,515 | 10/1992 | Haynes | 124/20.1 |
| 5,669,822 | 9/1997 | Smollar et al. | 472/117 |
| 5,862,990 | 1/1999 | White | 239/289 |

*Primary Examiner*—Andres Kashnikow
*Assistant Examiner*—Jorge Bocanegra

[57] ABSTRACT

A trampoline sprinkler system is provided including an elongated tube constructed from a water impermeable, flexible, collapsible material. The tube preferably has a uniform circular cross-section along an entire length thereof. The elongated tube is configured to define a pair of discrete closed ends, an inner periphery, an outer periphery, an upper apex, and a lower apex. The elongated tube further has at least one row of apertures formed between the inner periphery and the upper apex of the tube along the entire length thereof. Next provided is a linear coupling pipe mounted on the tube for coupling with a water source, wherein water is sprayed upwardly and inwardly with respect to the elongated tube.

1 Claim, 2 Drawing Sheets

TRAMPOLINE SPRINKLER SYSTEM

BACKGROUND OF THE INVENTION

1. Field of the Invention

The present invention relates to sprinklers and more particularly pertains to a new trampoline sprinkler system for providing a fine mist of spray on a trampoline, on the ground, or the like.

2. Description of the Prior Art

The use of sprinklers is known in the prior art. More specifically, sprinklers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,121,882; U.S. Pat. No. 5,027,455; U.S. Pat. No. Des. 210,074; U.S. Pat. No. 4,765,542; U.S. Pat. No. 5,322,342; and U.S. Pat. No. 2,761,733.

In these respects, the trampoline sprinkler system according to the present invention substantially departs from the conventional concepts and designs of the prior art, and in so doing provides an apparatus primarily developed for the purpose of providing a fine mist of spray on a trampoline, on the ground, or the like.

SUMMARY OF THE INVENTION

In view of the foregoing disadvantages inherent in the known types of sprinklers now present in the prior art, the present invention provides a new trampoline sprinkler system construction wherein the same can be utilized for providing a fine mist of spray on a trampoline, on the ground, or the like.

The general purpose of the present invention, which will be described subsequently in greater detail, is to provide a new trampoline sprinkler system apparatus and method which has many of the advantages of the sprinklers mentioned heretofore and many novel features that result in a new trampoline sprinkler system which is not anticipated, rendered obvious, suggested, or even implied by any of the prior art sprinklers, either alone or in any combination thereof.

To attain this, the present invention is adapted for use with a trampoline having a lower annular support and an upper annular support with a diameter less than that of the lower annular support. The upper annular support is connected to the lower annular support via a plurality of stanchions. A flexible circular mat is provided with a periphery coupled to an inner edge of the upper annular support by way of a plurality of radially spaced springs. The present invention includes an elongated tube constructed from a water impermeable, flexible, collapsible material. As shown in FIG. 2, the tube has a uniform circular cross-section along an entire length thereof. Further, a diameter of the tube is about equal to that of the upper annular support. In a first embodiment, the elongated tube is configured in an annular or ring-like configuration. As such, a pair of discrete closed ends, an inner periphery, an outer periphery, an upper apex, and a lower apex are defined. The elongated tube preferably has a plurality of staggered rows of apertures formed between the inner periphery and the upper apex of the tube along the entire length thereof. Next provided is a linear coupling pipe having an inboard end coupled to an outer periphery of the tube. The coupling pipe is preferably positioned adjacent to and spaced from a first end of the tube and extends radially therefrom. The coupling pipe has an outboard portion with a reduced diameter and a plurality of threads formed therein. The coupling pipe is adapted for removably coupling with a garden hose to receive water therefrom. When such water is received, water is dispensed from the apertures inwardly and upwardly from the tube. As shown in FIG. 4, a plurality of strap assemblies are spacedly positioned along the entire length of the tube. Each strap assembly includes a pair of flexible planar rectangular strips each with an inboard end mounted along the inner periphery of the tube and extending inwardly therefrom. A bottom surface of an outboard end of each of the strips has a pile fastener mounted thereon. By this structure, the straps are adapted for attaching the tube along an outer periphery of the upper annular support of the trampoline.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and lo the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trampoline sprinkler system apparatus and method which has many of the advantages of the sprinklers mentioned heretofore and many novel features that result in a new trampoline sprinkler system which is not anticipated, rendered obvious, suggested, or even implied by any of the prior art sprinklers, either alone or in any combination thereof.

It is another object of the present invention to provide a new trampoline sprinkler system which may be easily and efficiently manufactured and marketed.

It is a further object of the present invention to provide a new trampoline sprinkler system which is of a durable and reliable construction.

An even further object of the present invention is to provide a new trampoline sprinkler system which is susceptible of a low cost of manufacture with regard to both materials and labor, and which accordingly is then susceptible of low prices of sale to the consuming public, thereby making such trampoline sprinkler system economically available to the buying public.

Still yet another object of the present invention is to provide a new trampoline sprinkler system which provides in the apparatuses and methods of the prior art some of the advantages thereof, while simultaneously overcoming some of the disadvantages normally associated therewith.

Still another object of the present invention is to provide a new trampoline sprinkler system for providing a fine mist of spray on a trampoline, on the ground, or the like.

Even still another object of the present invention is to provide a new trampoline sprinkler system that includes an elongated tube constructed from a water impermeable, flexible, collapsible material. The tube preferably has a uniform circular cross-section along an entire length thereof. The elongated tube is configured to define a pair of discrete closed ends, an inner periphery, an outer periphery, an upper apex, and a lower apex. The elongated tube further has at least one row of apertures formed between the inner periphery and the upper apex of the tube along the entire length thereof. Next provided is a linear coupling pipe mounted on the tube for coupling with a water source, wherein water is sprayed upwardly and inwardly with respect to the elongated tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
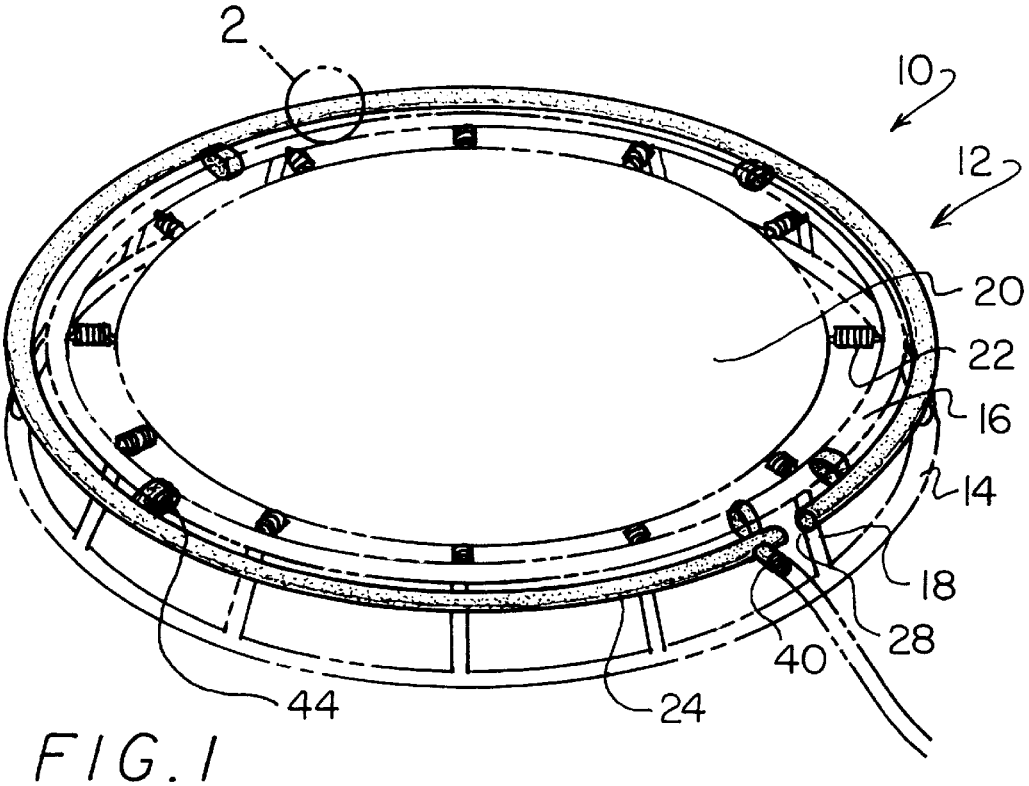
FIG. 1 is a perspective view of a new trampoline sprinkler system according to the present invention.

With reference now to the drawings, and in particular to FIGS. 1 through 6 thereof, a new trampoline sprinkler system embodying the principles and concepts of the present invention and generally designated by the reference numeral 10 will be described.

The present invention, designated as numeral 10, is adapted for use with a trampoline 12 having a lower annular support 14 and an upper annular support 16 with a diameter less than that of the lower annular support. The upper annular support is connected to the lower annular support via a plurality of stanchions 18. A flexible circular mat 20 is provided with a periphery coupled to an inner edge of the upper annular support by way of a plurality of radially spaced springs 22.

Figure 2:
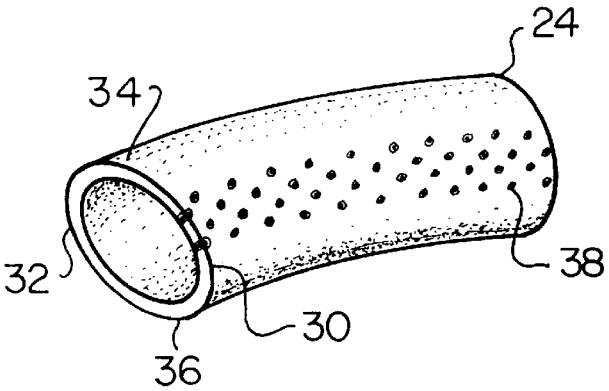
FIG. 2 is a sectional view of the present invention showing the apertures formed in the tube.
Figure 3:
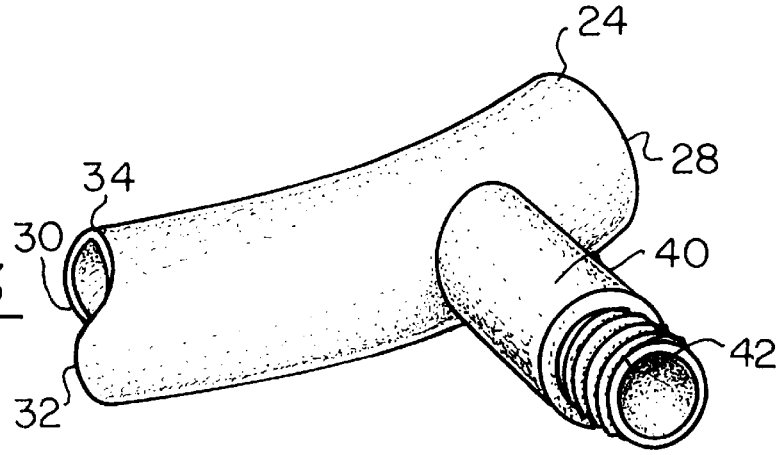
FIG. 3 is a perspective view of the coupling pipe of the present invention.

The present invention includes an elongated tube 24 constructed from a water impermeable, flexible, collapsible material such as rubber or vinyl. By using a flexible, collapsible material, the present invention is capable of being conveniently stored when not in use. Ideally, the elongated tube has a perimeter of 14–16 feet. As shown in FIG. 2, the tube has a uniform circular cross-section along an entire length thereof. Further, a diameter of the tube is about equal to that of the upper annular support. In a first embodiment, the elongated tube is configured in an annular or ring-like configuration. In an alternate embodiment 26, the tube may take on a rectangular configuration or the like. As such, a pair of discrete closed ends 28, an inner periphery 30, an outer periphery 32, an upper apex 34, and a lower apex 36 are defined.

The elongated tube preferably has a plurality of staggered rows of apertures 38 formed in an area between the inner periphery and the upper apex of the tube along the entire length thereof. In the preferred embodiment, such area is colored a unique color with respect to the remaining portion of the tube to facilitate identification of the position of the apertures. At least three of such rows are preferably employed. Such rows are preferably spacedly from the upper apex and the inner periphery of the tube. In the preferred embodiment, the apertures are sized to effect a fine mist spray during use.

Next provided is a linear coupling pipe 40 having an inboard end coupled to an outer periphery of the tube. The coupling pipe is preferably positioned adjacent to and spaced from a first end of the tube and extends radially therefrom. The coupling pipe has an outboard portion with a reduced diameter and a plurality of threads 42 formed therein. The coupling pipe is adapted for removably coupling with a garden hose to receive water therefrom. When such water is received, water is dispensed from the apertures inwardly and upwardly from the tube.

Figure 4:
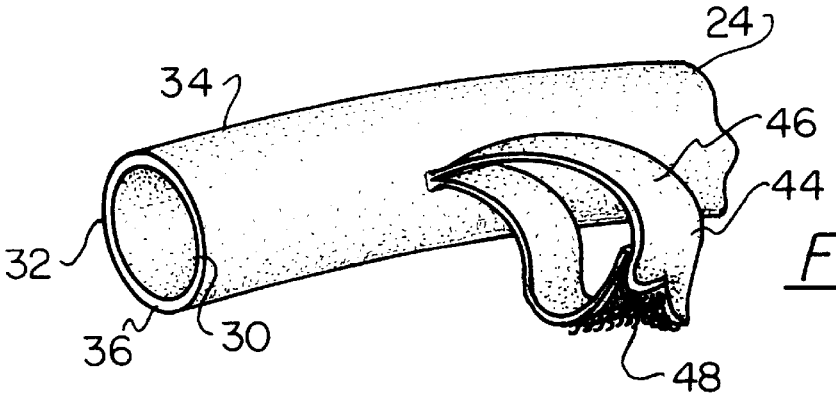
FIG. 4 is a perspective view of one of the straps of the present invention.
Figure 5:
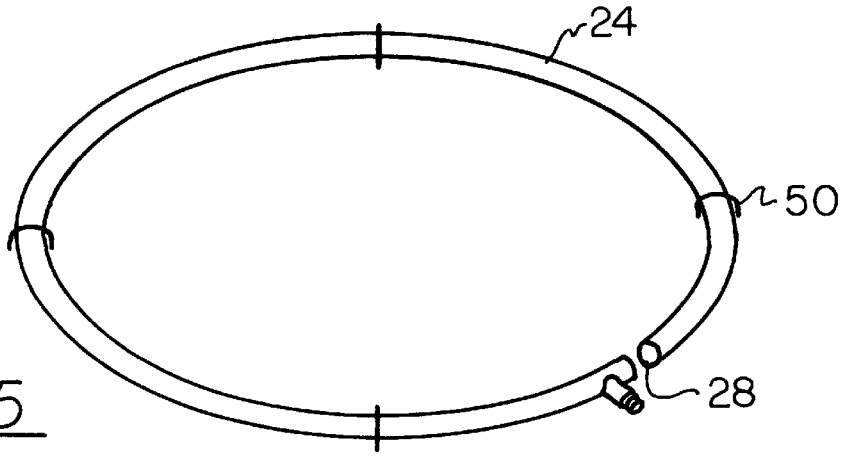
FIG. 5 is a perspective view of a first embodiment of the present invention wherein the tube has an annular configuration.
Figure 6:
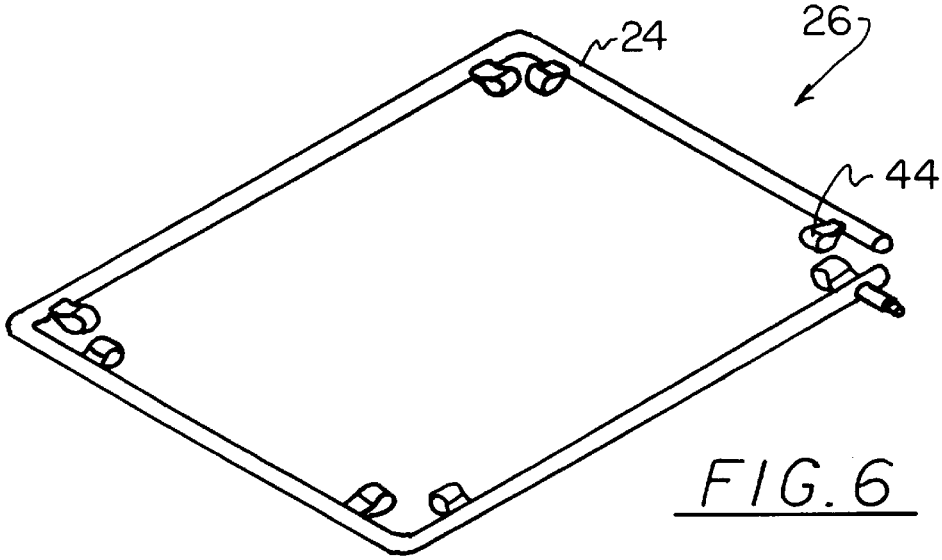
FIG. 6 is a perspective view of a second embodiment of the present invention wherein the tube has a rectangular configuration.

As shown in FIG. 4, at least four strap assemblies 44 are equally spaced about 3–4 feet along the entire length of the tube. Each strap assembly includes a pair of flexible planar rectangular strips 46 each with an inboard end mounted along the inner periphery of the tube and extending inwardly therefrom. A bottom surface of an outboard end of each of the strips has a pile fastener 48 mounted thereon. By this structure, the straps are adapted for attaching the tube along an outer periphery of the upper annular support of the trampoline.

Finally, a plurality of inverted U-shaped stakes 50 are included for releasably securing the tube to a ground surface. As such, the present invention may be used in two modes one of which includes the trampoline and another of which excludes the trampoline.

As to a further discussion of the manner of usage and operation of the present invention, the same should be apparent: from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trampoline sprinkler system comprising, in combination:

a trampoline including a lower annular support, an upper annular support with a diameter less than that of the lower annular support and connected to the lower annular support via a plurality of stanchions, a flexible circular mat with a periphery coupled to an inner edge of the upper annular support by way of a plurality of radially spaced springs;

an elongated tube constructed from a water impermeable, flexible, collapsible material having a uniform circular cross-section along an entire length thereof and a diameter about equal to that of the upper annular support, the elongated tube being configured in an annular configuration with the tube being positioned radially outward from the upper annular support, the elongated tube having a pair of discrete closed ends, an inner periphery, an outer periphery, an upper apex, and a lower apex, the elongated tube further having a plurality of staggered rows of apertures formed between the inner periphery and the upper apex of the tube along the entire length thereof, wherein water is sprayed from the elongated tube upwardly and inwardly with respect to the tube;

a linear coupling pipe having an inboard end coupled to an outer periphery of the tube adjacent to and spaced from a first end thereof and extending radially therefrom, the coupling pipe having an outboard portion with a reduced diameter and a plurality of threads formed therein for removably coupling with a garden hose to receive water therefrom and dispensing the water from the apertures inwardly and upwardly from the tube;

a plurality of strap assemblies spacedly positioned along the entire length of the tube, each strap assembly including a pair of flexible planar rectangular strips each with an inboard end mounted along the inner periphery of the tube and extending inwardly therefrom, wherein a bottom surface of an outboard end of each of the strips has a pile fastener mounted thereon for releasably attaching the outboards ends together for mounting the tube along an outer periphery of the upper annular support of the trampoline; and a plurality of inverted U-shaped stakes for releasably securing the tube to a ground surface.

* * * * *